US009303524B2

(12) United States Patent
Hensley et al.

(10) Patent No.: US 9,303,524 B2
(45) Date of Patent: Apr. 5, 2016

(54) VARIABLE AREA TURBINE NOZZLE WITH A POSITION SELECTOR

(71) Applicant: Solar Turbines Incorporated, San Diego, CA (US)

(72) Inventors: John James Hensley, San Diego, CA (US); Ulrich Edmund Stang, Solana Beach, CA (US)

(73) Assignee: Solar Turbines Incorporated, San Diego, CA (US)

( * ) Notice: Subject to any disclaimer, the term of this patent is extended or adjusted under 35 U.S.C. 154(b) by 981 days.

(21) Appl. No.: 13/660,849

(22) Filed: Oct. 25, 2012

(65) Prior Publication Data

US 2014/0154046 A1 Jun. 5, 2014

(51) Int. Cl.
*F01D 17/04* (2006.01)
*F01D 17/16* (2006.01)

(52) U.S. Cl.
CPC ..... *F01D 17/162* (2013.01)

(58) Field of Classification Search
CPC ..... F01D 9/042; F01D 17/16; F01D 17/162
USPC ..... 415/159, 160, 162
See application file for complete search history.

(56) References Cited

U.S. PATENT DOCUMENTS

| | | | | |
|---|---|---|---|---|
| 3,013,771 | A * | 12/1961 | Henny | 415/160 |
| 3,263,963 | A * | 8/1966 | Hanschke et al. | 416/205 |
| 3,990,809 | A | 11/1976 | Young et al. | |
| 4,003,675 | A | 1/1977 | Stevens et al. | |
| 4,821,979 | A | 4/1989 | Denning et al. | |
| 4,867,635 | A * | 9/1989 | Tubbs | 415/159 |
| 6,471,471 | B1 | 10/2002 | Bouyer | |
| 2007/0160463 | A1* | 7/2007 | Jahns | 415/160 |
| 2015/0098813 | A1* | 4/2015 | Jarrett et al. | 415/209.3 |

* cited by examiner

*Primary Examiner* — Igor Kershteyn
*Assistant Examiner* — Woody A Lee, Jr.
(74) *Attorney, Agent, or Firm* — Procopio, Cory, Hargreaves & Savitch LLP

(57) ABSTRACT

A gas turbine engine (100) variable nozzle (460) includes an outer shroud (461), an inner shroud (462), a variable nozzle airfoil (463), and a position selector (470). The inner shroud (462) is located radially inward from the outer shroud (461). The variable nozzle airfoil (463) extends radially between the outer shroud (461) and the inner shroud (462). The variable nozzle airfoil (463) includes a vane shaft (464) extending radially outward from the variable nozzle airfoil (463) through the outer shroud (461). The position selector (470) is coupled with the variable nozzle airfoil (463) to fixedly lock the variable nozzle airfoil (463) into one of a plurality of preselected positions.

20 Claims, 4 Drawing Sheets

VARIABLE AREA TURBINE NOZZLE WITH A POSITION SELECTOR

TECHNICAL FIELD

The present disclosure generally pertains to gas turbine engines, and is more particularly directed toward a variable area turbine nozzle with a position selector.

BACKGROUND

Gas turbine engines include compressor, combustor, and turbine sections. Gas turbine engines may be operated in various ambient conditions such as hot or cold, and humid or dry conditions. The ambient temperature and the amount of humidity in the air may affect efficiency of a gas turbine engine.

U.S. Pat. No. 4,003,675 to W. Stevens discloses a mechanism for varying the position of a plurality of nozzle vanes in a gas turbine engine. The mechanism includes a single double -acting hydraulic actuating jack disposed between two bell cranks for simultaneously applying force to a ring gear at two diametrically opposed connection points. The single actuating jack applies equal and opposite forces to the diametrically opposed connection points on the ring gear and reduces distortion producing stresses therein. The ring gear simultaneously engages a plurality of individual gear segments rotatable with each individual nozzle vane in the engine. Movement of the single actuator jack causes balanced rotation of the ring gear and simultaneous rotation of the nozzle vanes.

The present disclosure is directed toward overcoming one or more of the problems discovered by the inventors.

SUMMARY OF THE DISCLOSURE

A gas turbine engine variable nozzle includes an outer shroud, an inner shroud, a variable nozzle airfoil and a position selector. The inner shroud is located radially inward from the outer shroud. The variable nozzle airfoil extends radially between the outer shroud and the inner shroud. The variable nozzle airfoil includes a vane shaft extending radially outward from the variable nozzle airfoil through the outer shroud. The position selector is coupled with the variable nozzle airfoil to fixedly lock the variable nozzle airfoil into one of a plurality of pre-selected positions.

A method of operating a gas turbine engine is also disclosed. The method includes providing a position selector with a discrete number of variable nozzle airfoil clocking positions. The method also includes selecting one of the clocking positions of the position selector. The method also includes rotating a variable nozzle airfoil while the gas turbine engine is not operating by rotating the position selector into the selected clocking position. The method further includes fixing the angle of the variable nozzle airfoil and clocking position of the position selector with a selector bolt.

DETAILED DESCRIPTION

The systems and methods disclosed, herein include a gas turbine engine nozzle with a variable nozzle airfoil, in embodiments, the gas turbine engine nozzle includes an outer shroud, an inner shroud, and a rotatable variable turbine nozzle airfoil extending there between. A vane shaft extends radially outward to a keyed position selector configured With multiple clocking locations. The clocking locations may allow the variable nozzle airfoils to be simultaneously rotated and locked into position while the engine is shut down or during on site maintenance of the gas turbine engine. Changing the angle of the variable nozzle airfoils may increase the gas turbine engine power and efficiency outputs in hot arid conditions and may increase the gas turbine engine durability in cold conditions.

Figure 1:
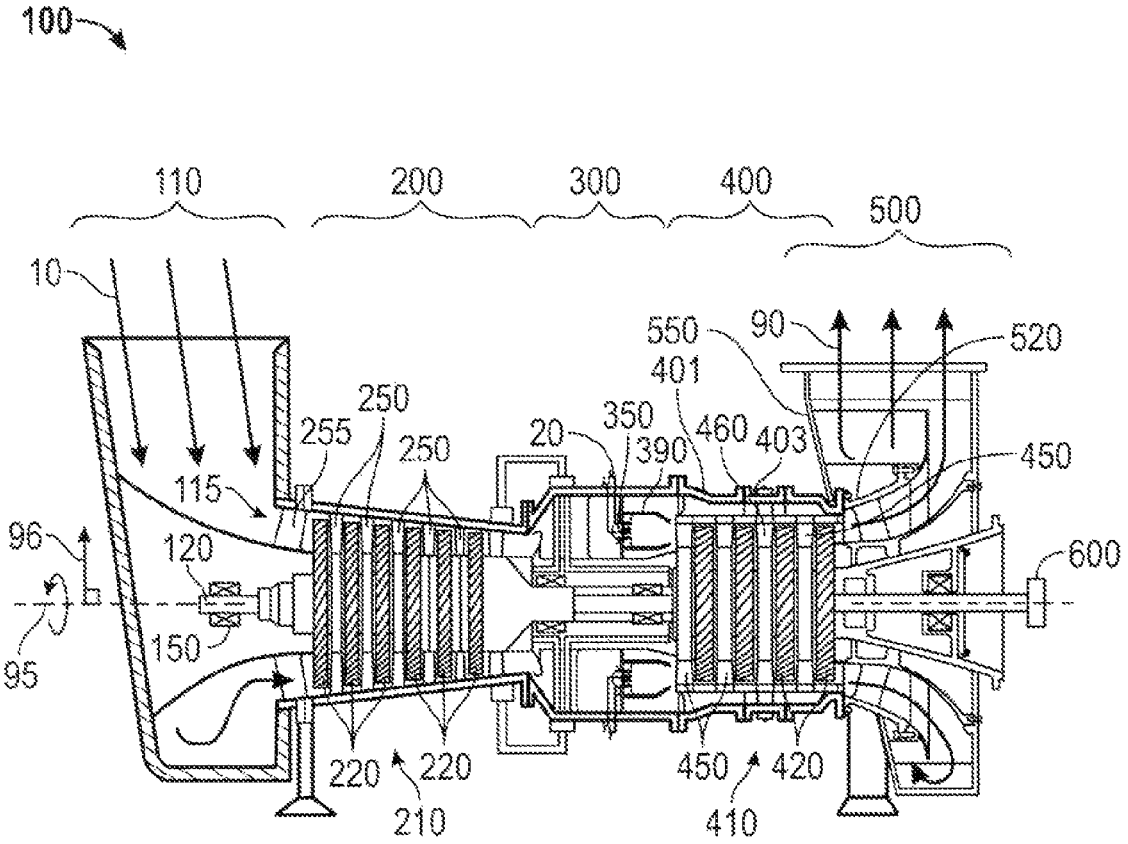
FIG. 1 is a schematic illustration of an exemplary gas turbine engine.

FIG. 1 is a schematic illustration of an exemplary gas turbine engine. Some of the surfaces have been left out or exaggerated (here and in other figures) for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may fee generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a shaft 120, a gas producer or "compressor" 200, a combustor 300, a turbine 400, an exhaust 500, and a, power output coupling 600. The gas turbine engine 100 may have a single shaft or a dual shaft configuration.

The compressor 200 includes a compressor rotor assembly 210, compressor stationary vanes ("stators") 250, and inlet guide vanes 255. The compressor rotor assembly 210 mechanically couples to shaft 120. As illustrated, the compressor rotor assembly 210 is an axial flow rotor assembly. The compressor rotor assembly 210 includes one or more compressor disk assemblies 220. Each compressor disk assembly 220 includes a compressor rotor disk that is circumferentially populated with compressor rotor blades. Stators 250 axially follow each of the compressor disk assemblies 220. Each compressor disk assembly 220 paired with the adjacent stators 250 that follow the compressor disk assembly 220 is considered a compressor stage. Compressor 200 includes multiple compressor stages. Inlet guide vanes 255 axially precede the first compressor stage.

The combustor 300 includes one or more injectors 350 and includes one or more combustion chambers 390.

Figure 2:
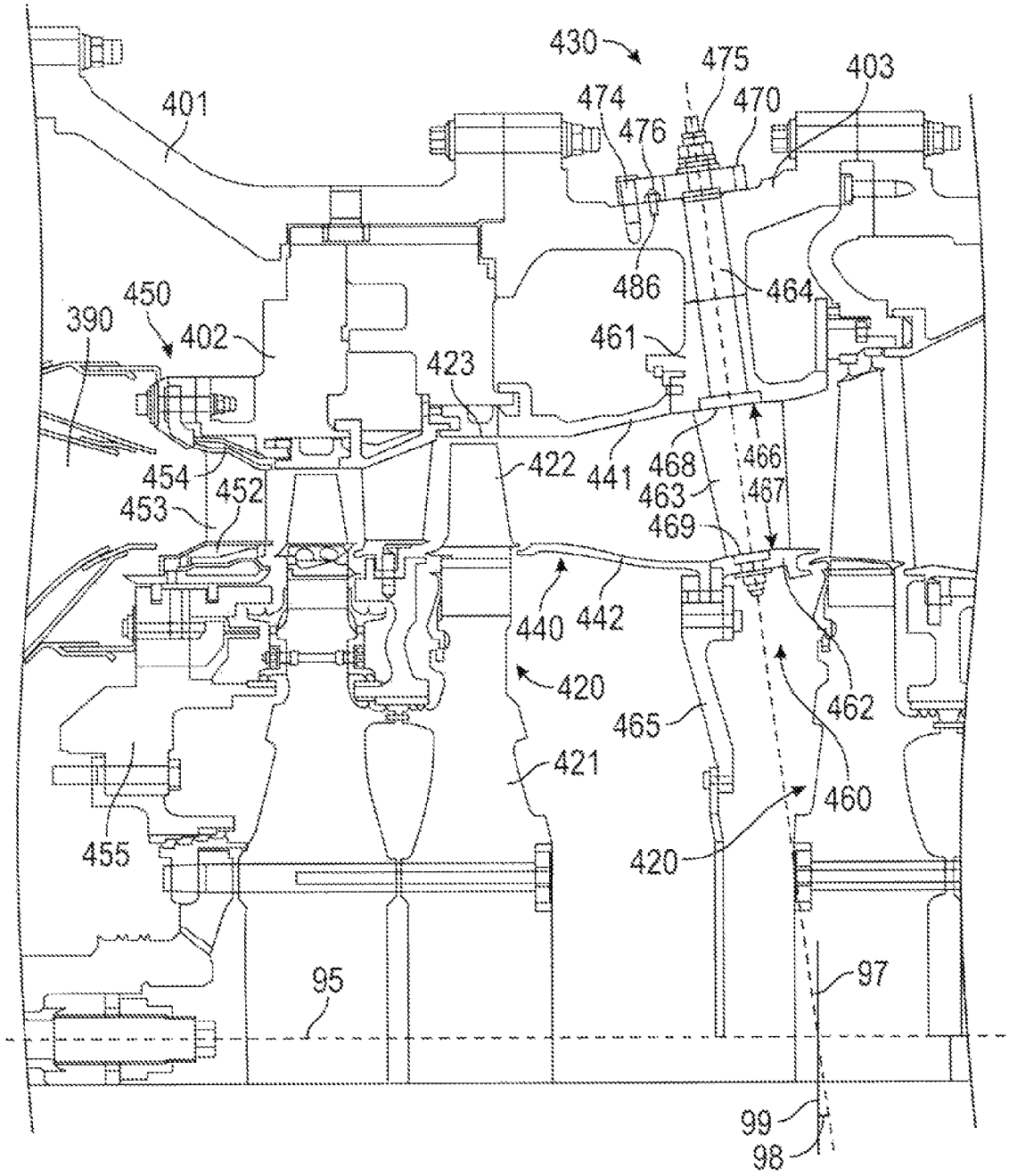
FIG. 2 is a cross-sectional view of a portion of the gas turbine engine turbine of FIG. 1.

The turbine 400 includes a turbine rotor assembly 410, turbine nozzles 450, and one or more turbine diaphragms 455 (shown in FIG. 2). The turbine rotor assembly 410 mechanically couples to the shaft 120. As illustrated, the turbine rotor assembly 410 is an axial flow rotor assembly. The turbine rotor assembly 410 includes one or more turbine disk assemblies 420. Each turbine disk assembly 420 includes a turbine disk 421 (shown in FIG. 2) that is circumferentially populated with turbine blades 422 (shown in FIG. 2). Turbine nozzles 450 axially precede each of the turbine disk assemblies 420. Each turbine nozzle 450 may be a variable nozzle 460. Each variable nozzle 460 may include one or more variable nozzle airfoils 463 (shown in FIG. 2). The angle of each variable nozzle airfoil 463 may be controlled by position selector 470.

Each turbine disk assembly 420 paired with the adjacent turbine nozzles 450 that precede the turbine disk assembly 420 is considered a turbine stage. Turbine 400 includes multiple turbine stages. In the embodiment shown in FIG. 1, the third stage turbine nozzles 450 arc variable nozzles 460. While variable nozzles 460 are shown in the thud turbine stage in this embodiment, variable nozzles 460 may be in any turbine stage of a gas turbine engine.

The exhaust 500 includes an exhaust, diffuser 520 and an exhaust collector 550.

FIG. 2 is a cross-sectional view of a portion of the turbine 400 of FIG. 1. The turbine 400 may include an outer housing 401 and an inner housing 402. The outer housing 401 may circumferentially extend around the turbine section. The inner housing 402 may extend radially inward from the outer housing 401. Components, such as turbine blade shrouds 423, of the gas turbine engine 100 may hang from or attach to inner housing 402. Turbine blade shrouds 423 surround each turbine disk assembly 420.

Each turbine nozzle 450 includes an outer band 454, an inner band 452, and one or more nozzle airfoils 453. Outer band 454 is the radially outer arcuate portion of turbine nozzle 450. Outer band 454 may attach to inner housing 402. Inner band 452 is located radially inward from outer band 454 and is the radially inner arcuate portion of turbine nozzle 450. Inner band 452 may attach to turbine diaphragm 455. Each nozzle airfoil 453 extends between inner band 452 and outer band 454. Each turbine nozzle 450 generally includes two to four nozzle airfoils 453.

In the embodiment shown in FIG. 2. the third stage includes variable nozzle assembly 430. Variable nozzle assembly 430 is a stand-alone module that may include variable outer housing 403, a variable nozzle stage including variable nozzles 460, inter turbine duct 440, position selector 470, and selector bolt 474. Variable outer housing 403 may be the radially outermost portion of variable nozzle assembly 430. Variable outer housing 403 may attach to or be part of outer housing 401.

The variable nozzle stage includes multiple variable nozzles 460 circumferentially aligned to form a ring shape. The variable nozzle stage may be configured to form a gas path between a first ring surface and a second ring surface. The first ring surface and the second ring surface may each, be the shape of a spherical zone. A spherical zone is the portion of the surface of a sphere included between two parallel planes cutting-through the sphere. In one embodiment, the first ring surface and the second ring surface are from concentric spheres cut by a plane perpendicular to center axis 95 near the equator of each sphere defining the spherical zones and a plane axially forward of the plane cutting the sphere near the equator. The first ring surface may define the outer surface of the variable nozzle stage gas path and the second ring surface may define the inner surface of the variable nozzle stage gas path, Multiple variable nozzles 460 are assembled together circumferentially to form the variable nozzle stage. Each variable nozzle 460 includes an outer shroud 461, an inner shroud 462, and a variable nozzle airfoil 463. The outer shroud 461 may extend radially outward and contact variable outer housing 403. Inner shroud 462 is located radially inward from outer shroud 461. Inner shroud 462 may be axially aligned with outer shroud 461.

Outer shroud 461 may include first spherical surface 466. First spherical surface 466 may be the radially inner surface of outer shroud 461. First spherical surface 466 maybe a circumferential portion of the first ring surface or a circumferential portion of a spherical zone. Inner shroud 462 may include second spherical surface 467. Second spherical surface 467 may be the radially outer surface of inner shroud 462 and may be situated opposite first spherical surface 466. Second spherical surface 467 maybe a circumferential portion of the second ring surface or a circumferential portion of a spherical zone. Second spherical surface 467 may be circumferentially aligned with first spherical surface 466. First spherical surface 466 and second spherical surface 467 may be. configured to form a portion of an annular nozzle exit in the axial direction.

A variable nozzle airfoil 463 extends radially between outer shroud 461 and inner shroud 462. Each variable nozzle 460 may include one or multiple variable nozzle airfoils 463. In one embodiment each variable nozzle 460 includes one variable nozzle airfoil 463. In another embodiment, each variable nozzle 460 includes two to four variable nozzle airfoils 463.

Each variable nozzle airfoil 463 includes an outer edge 468 and an inner edge 469. Outer edge 468 is the radially outer edge of variable nozzle airfoil 463 and may be adjacent to first spherical surface 466. Outer edge 468 may have a curve which matches the spherical contour of first spherical surface 466. Inner edge 469 is the radially inner edge of variable nozzle airfoil 463 and may be adjacent to second spherical surface 467. Inner edge 469 may have a curve which matches the spherical contour of second spherical surface 467.

Each variable nozzle airfoil 463 may include an integral shaft such as vane shaft 464. Vane shaft 464 may extend radially outward through and beyond outer shroud 461 and variable outer housing 403. Vane shaft 464 may extend within variable nozzle airfoil 463 between outer shroud 461 and inner shroud 462. In one embodiment the variable nozzle stage includes between thirty to forty variable nozzle airfoils. In another embodiment, the variable nozzle stage includes thirty-six variable nozzle airfoils 463.

Axis 97 of each variable nozzle airfoil 463 and vane shaft 464 may be leaned axially forward, towards the compressor section, at angle 98 to create a diverging gas path with a cylindrical exit. Angle 98 is the angle between axis 97 and vertical line 99 extending vertically from center axis 95. In one embodiment angle 98 is between five and fifteen degrees. In another embodiment angle 98 is seven and one half degrees.

Position selector 470 is coupled with variable nozzle airfoil 463 to fixedly lock variable nozzle airfoil 463 to one of a plurality of preselected positions. As previously mentioned, vane shaft 464 may extend through variable outer housing 403. In the embodiment shown in FIG. 2, position selector 470 is coupled to vane shaft 464. The coupling between position selector 470 and vane shaft 464 may prevent relative angular displacement between position selector 470 and Vans shah 464.

Also shown in the embodiment in FIG. 2, vane shaft 464 extends through position selector 470 and is keyed to vane shaft 464 with flats. Position selector 470 may be located radially outward of and adjacent to variable outer housing 403. A flexible seal may be installed between position selector 470 and variable outer housing 403. The variable nozzle assembly 430 may include one position selector 470 for every variable nozzle airfoil 463.

Variable nozzle assembly 430 may include locking nut 475. Locking nut 475 may be located on the outer end of vane shaft 464. Locking nut 475 may preload and restrain variable nozzle assembly 430. Variable outer housing 403 may include dowel pins 486 extending radially outward. Position selector 470 may be configured to include dowel hole 476 to receive a dowel pin 486. Dowel hole 476 extends partially into position selector 470. Dowel hole 476 maybe a blind bole or may have a cylindrical or slot shaped configuration. The size or length of dowel hole 476 may be determined by the desired amount of rotation and positions of variable nozzle airfoil 463.

Position selector 470 may include selector bolt 474 that may pass through one of a discrete number of holes or notches that ay be located through position selector 470. Selector bolt 474 may insert into variable outer housing 403 to fixedly attach position selector 470 to variable outer housing 403. Multiple predetermined airfoil clocking positions for each variable nozzle airfoil 463 may be created from the discrete number of holes or notches in position selector 470 combined with a hole in variable outer housing 403.

Figure 3:
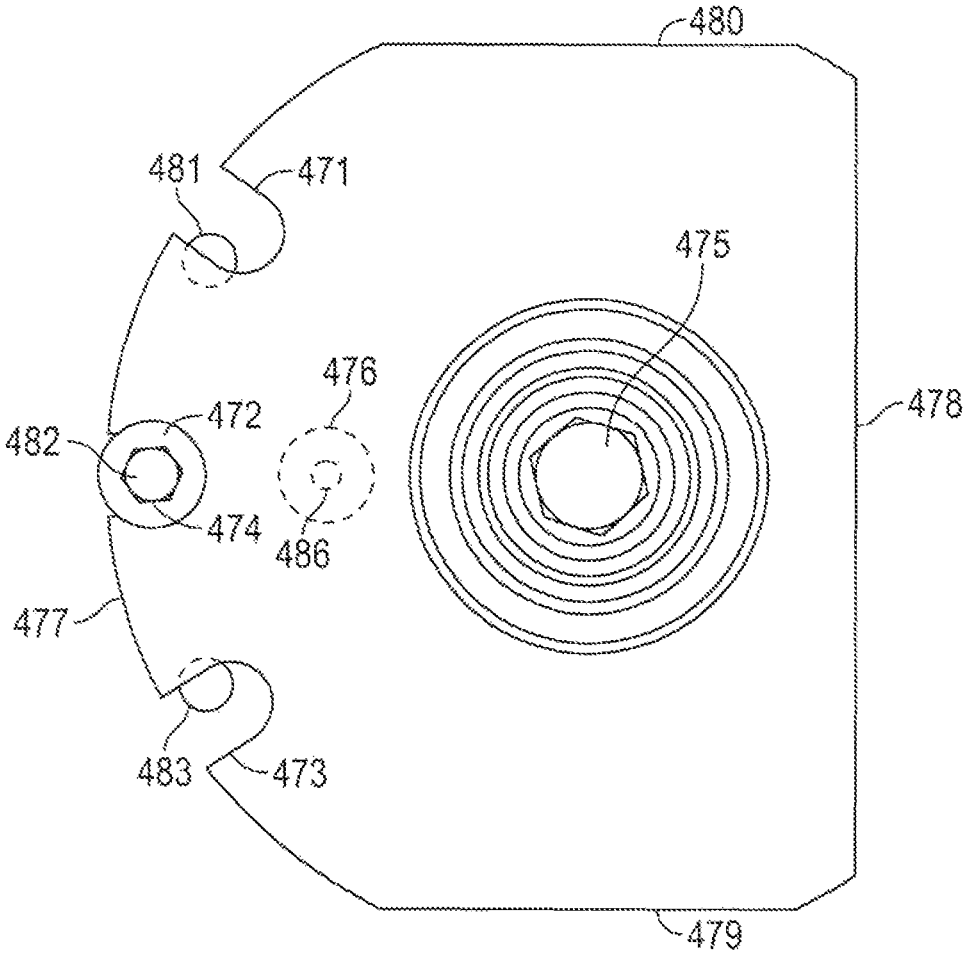
FIG. 3 is a top view of the position selector of FIG. 2.

FIG. 3 is a top view of the position selector 470 of FIG. 2. Position selector 470 may have a plate like shape and may include forward edge 477, aft edge 478. first alignment edge 479, and second alignment edge 480. Forward edge 477 is the axially forward edge of position selector 470. In the embodiment shown in FIG. 3, forward edge 477 is an arc centered on axis 97. Aft edge 478 is the axially aft edge of position selector 470. First alignment edge 479 is located on one side of position selector 470 and second alignment edge 480 is located on the side opposite and distal to first alignment edge 479.

The width of position selector 470 between first alignment edge 479 and second alignment edge 480 may be such that adjacent position selectors 470 are separated by a small gap between first alignment edge 479 and second alignment edge 480 when installed about a variable nozzle stage. First alignment edge 479 and second alignment edge 480 may be parallel or keyed such that adjacent position selectors 470 installed in the variable nozzle assembly 430 can only rotate together preventing independent rotation of adjacent position selectors 470.

In the embodiment shown in FIG. 3, position selector 470 includes three discrete clocking positions, cold position 471 standard position 472, and hot position 473, for locking each variable nozzle airfoil 463 in a discrete position. Variable outer housing 403 may include multiple holes that may be aligned with the clocking positions to set the variable nozzle airfoil 463 in one of the discrete number of predetermined gas turbine engine operating conditions. In the embodiment shown in FIG. 3, variable outer housing 403 includes three discrete selections, which includes cold hole 481, a standard hole 482, and a hot hole 483. Cold position 471 and cold bole 481 align for a cold operating condition; standard position 472 and standard hole 482 align for a standard operating condition; and hot position 473 and hot hole 483 align for a hot operating condition. In the embodiment shown in FIG. 3, standard position 472 and standard hole 482 are shown aligned with selector holt 474 inserted, into standard hole 482 through, standard position 472, locking position selector 470 and variable nozzle airfoil 463 into the standard operating condition.

Referring again to FIG. 2, when forming a variable nozzle stage with variable nozzles 460, intersegment strip seals may be used between circumferentially adjacent variable outer shrouds 461 and between circumferentially adjacent variable inner shrouds 462.

Inter turbine duct 440 may axially precede variable nozzles 460. Inter turbine duct 440 may extend from the aft end of the turbine stage forward and proximal to the variable nozzle assembly 430 to variable nozzles 460. Inter turbine duet 440 may include outer wall 441 and inner wall 442, Outer wall 441 may be the radially outer portion of inter turbine duct 440. Inner wall. 442 may be located radially inward from outer wail 441 and may be axially aligned with outer wall 441. Outer wall 441 and inner wall 442 may diverge as inter turbine duct 440 extends towards variable nozzles 460.

Outer wall 441 and inner wall 442 may be circumferentially segmented and may be assembled with inter turbine duct dowel pins. Outer wall 441 may be axially restrained by a retaining ring. Inner wall 442 may be coupled to variable diaphragm 465 along with inner shroud 462 and a clamp ring.

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal, alloys.

INDUSTRIAL APPLICABILITY

Gas turbine engines may be suited for any number of industrial applications such as various aspects of the oil and gas industry (including transmission, gathering, storage, withdrawal, and lifting of oil and natural gas), the power generation industry, cogeneration, aerospace, and other transportation industries.

Referring to FIG. 1, a gas (typically air 10) enters the inlet 110 as a "working fluid", and is compressed by the compressor 200. In the compressor 200, the working fluid is compressed in an annular flow path 115 by the series of compressor disk assemblies 220. In particular, the air 10 is compressed in numbered "stages", the stages being associated with each compressor disk assembly 220. For example, "4th stage air" may be associated with, the 4th compressor disk assembly 220 In the downstream or "aft" direction, going from the inlet 110 towards the exhaust 500), Likewise, each turbine disk assembly 420 may be associated with a numbered stage.

Once compressed air 10 leaves the compressor 200, it enters the combustor 300, where it is diffused, and fuel 20 is added. Air 10 and fuel 20 are injected into the combustion chamber 390 via injector 350 and ignited. After the combustion reaction, energy is then extracted from the combusted fuel/sir mixture via the turbine 400 by each stage of the series of turbine disk assemblies 420. Exhaust gas 90 may then be diffused in exhaust diffuser 520 and collected, redirected, and exit the system via. an exhaust collector 550. Exhaust gas 90 may also be further processed, (e.g., to reduce harmful emissions, and/or to recover heat from the exhaust gas 90).

Ambient temperatures and other environmental factors may affect, the efficiency and power output of gas turbine engines. High temperatures may cause a drop off in gas turbine engine efficiency and power output, while low temperatures may cause an increase in efficiency and power output. A higher power output may increase the torque and other forces within a gas turbine engine. These forces may exceed the material strengths of gas turbine engine components.

Adjusting the nozzle throat area by modifying the angle of each nozzle airfoil may increase the efficiency and power output in hotter environments and may decrease the power output and stresses within a gas turbine engine in colder environments. The angle of each nozzle airfoil may be adjusted manually or by an actuated system. Actuated systems may be expensive and may increase maintenance costs of a gas turbine engine. Actuated systems are complex, continually active linkage systems that adjust the turbine nozzles of a gas turbine engine. These linkage systems often fail and may significantly increase maintenance costs.

Variable nozzle assembly 430 may avoid such costs. Variable nozzle assembly 460 does not include a linkage system and is not continually actuated, which may reduce service costs. Variable nozzle assembly 430 includes variable nozzles 460, which include a discrete number of clocking positions. Referring now to FIG. 2, variable nozzle 460 clocking positions may be externally adjusted, which may reduce the service costs of adjusting variable nozzle assembly 430. Variable nozzles 460 may not need to be removed from the gas turbine engine 100 to adjust each variable nozzle airfoil 463. Position selectors 470, the setting mechanisms for each variable nozzle airfoil 463, may be completely accessible from the exterior of outer housing 401, including variable outer housing 403. Variable nozzle airfoils 463 may be unlocked by loosening locking nut 475 and removing selector bolt 474, may be rotated to various pre-determined nozzle throat area settings, and may be relocked, without any further disassembly of the gas turbine engine 100.

As shown in FIG. 3, position selectors 470 may include multiple stations, locations, or clocking positions to modulate variable nozzle airfoils 463 to a discrete number of predetermined locations for various temperature ranges. This may allow field service to optimize gas turbine engine 100 for regional conditions or seasonal changes. For example, field service may determine a standard day operating condition based on operator needs and the average ambient temperatures during operation of the gas turbine engine. Field service may provide a position selector with a clocking position for the standard day operating angle of the variable nozzle airfoils 463. Average ambient temperatures during the summer and winter months may vary from the average ambient temperatures during the rest of the year. Field service may add a clocking position for the determined cold day operating angle of the variable nozzle airfoils 463 based on average ambient temperatures during the winter months. Field service may also add a clocking position for the determined hot day operating angle based on average ambient temperatures during the summer months. Each gas turbine engine 100 may have customized position selectors 470 based on the needs of the operator and the ambient operating conditions of the gas turbine engine 100.

The embodiment shown in FIG. 3 includes a position selector 470 with three clocking positions, cold position 471 for cold day operation, standard position 472 for standard day operation, and hot position 473 for hot day operation. However, any number of discrete variations and predetermined settings may be used.

In another example, a position selector with predetermined temperature ranges for each clocking position may be provided. The cold position 471 may be selected for use in temperatures below a certain range such as 0 degrees Celsius. The hot position 473 may be selected for use in temperatures above a certain range such as 40 degrees Celsius.

Multiple methods may he used for fixing the operating angles of variable nozzle airfoils 463 with multiple clocking positions. For example, two clocking positions may use the same hole in variable outer housing 430. Similarly, one clocking position may be used with two holes in variable outer housing 430. These examples may best be suited for larger angles between operating angles, such as twenty degrees.

In another example, one hole in variable outer housing 430 is added for each, clocking position. This may help achieve small angles of variable nozzle airfoil 463 rotation, The smaller angles between operating angles may be accomplished by making the angle between two clocking positions slightly different than the angle between the two associated holes in variable outer housing 430. The difference between these two angles will be the amount of rotation of variable nozzle airfoil 463 when switching from one clocking position/hole pair to the other. An embodiment of this example is illustrated in FIG. 3. The position selector 470 is shown with a cold position 471, a standard position 472, and a hot position 473. FIG. 3 also shows the associated hole locations for the variable outer housing 430. Cold position 471 aligns with cold hole 481 for a cold operating condition, standard position 472 aligns with, standard hole 482 for a standard operating condition, and hot position 473 aligns with hot hole 483 for a hot operating condition.

As shown in FIG. 3, first, alignment edge 479 and second alignment edge 480 of position selector 470 may be parallel or keyed such that adjacent position selectors 470 installed in variable nozzle assembly 430 may not rotate independently. This shingling effect may prevent a mixture of clocking angles and may prevent variable nozzle airfoils 463 from being set at different angles within variable nozzle assembly 430. Misaligned airfoils in a nozzle ring or stage may lead to excess vibrations and early failure of gas turbine engine components.

Position selectors 470 installed upside down may lead to misaligned airfoils. As shown in FIG. 2, dowel pins 486 prevent an upside down installation of position selectors 470. Dowel hole 476 may be configured to only receive dowel pin 486 when position selector 470 is installed right side up with forward edge 477 oriented towards the compressor 200. The upside down surface of position selector 470 may contact dowel pin 486 and may prevent installation of position selector 470 while upside down.

Outer shroud 461, inner shroud 462, and one or more variable nozzle airfoils 463 are separate pieces and are assembled to form variable nozzle 460. Some leakage may occur between variable nozzle airfoils 463 and outer shroud 461, and variable nozzle airfoils 463 and inner shroud 462. The curve of outer edge 468 matching the contour of first spherical surface 466 may minimize the radial gap between variable nozzle airfoil 463 and outer shroud 461. The curve of inner edge 469 matching the contour of second spherical surface 467 may minimize the radial gap between variable nozzle airfoil 463 and inner shroud 462. The radial gaps may remain relatively constant as variable nozzle airfoils 463 are rotated relative to outer shroud 461 and inner shroud 462 due to the matching contours. The relatively constant radial gaps may also prevent variable nozzle airfoils from binding with outer shroud 461 or inner shroud 462 while the angle of variable nozzle airfoil 463 is being set. Outer edge 468 may be preloaded, against first spherical surface 466 by locking not 475 after the angle of variable nozzle airfoil 463 has been set, which may eliminate any significant gap between variable nozzle airfoil 463 and outer shroud 461 and may lead to an increase in efficiency.

Turbine nozzle outer and inner shrouds are generally configured as segments of a ring to allow for thermal expansion between circumferentially aligned outer shrouds and circumferentially aligned inner shrouds. Referring to FIG. 2, axis 97 of variable nozzle airfoils 463 is leaned forward to create a diverging gas path with a cylindrical exit with the flow exiting in the axial direction. The spherical shape of variable nozzle 460 may result in a slightly irregular gas path.

A larger airfoil count in a turbine nozzle stage may result in shorter chord length of each airfoil and an increase in the number of nozzles. An increase in nozzles may result in an increase In machining costs and increased leakage between nozzles. A reduced airfoil count in a turbine nozzle stage may result in a longer chord length of each variable nozzle airfoil 463 and a decrease in the number of nozzles. A longer chord length, of variable nozzle airfoils 463 may result in a need to lean variable nozzles 460 further forward, which may increase the gas path irregularity as air may have to enter variable nozzles 460 at a steeper angle. A variable nozzle airfoil 463 count between thirty and forty within a variable nozzle stage may result in an acceptable balance between a slightly irregular gas path, and machining costs and leakage between variable nozzles 460. Other factors may contribute, to the variable nozzle airfoil 463 count. In one embodiment, a variable nozzle airfoil 463 count of thirty-six meshes nicely with the bolt patterns of outer turbine housing flanges and results in a convenient width for position selector 470.

Variable nozzle airfoils 463 may be designed such that the center of aerodynamic pressure is downstream of axis 97. This may ensure that, in the event of a failure that would allow unrestrained variable nozzle airfoil 463 rotation during gas turbine engine 100 operation, the variable nozzle airfoil 463 would rotate Into a fully open position rather than a folly closed position.

Figure 4:
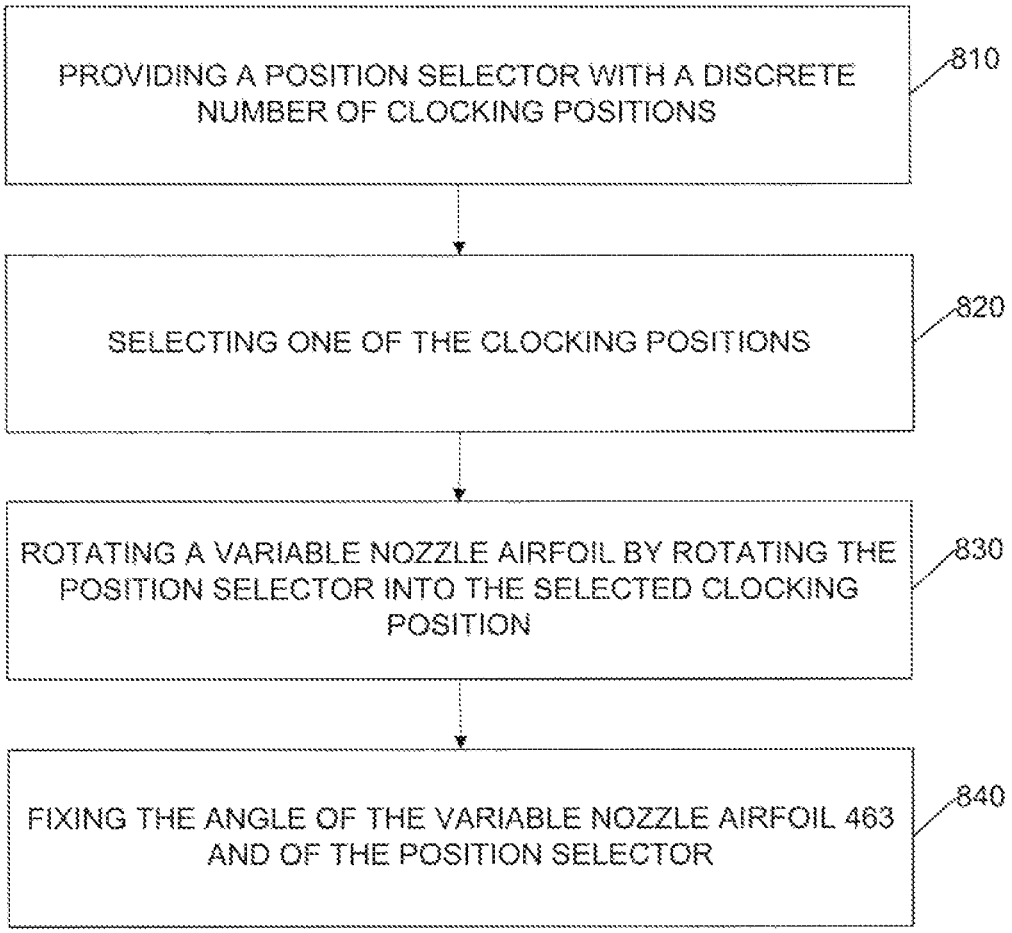
FIG. 4 is a method, for operating a gas turbine engine.

FIG. 4 is a flowchart of a method of operating a gas turbine engine 100. The method includes providing a position selector with a discrete number of variable nozzle airfoil 463 clocking positions at step 810. In one embodiment, position selector 470 depicted in FIG. 3 is provided. Step 810 is followed by selecting one of the clocking positions of the position selector 470 at step 820. Step 820 is followed by rotating a variable nozzle airfoil 463 while the gas turbine engine is not operating, by rotating the position selector 470 into the selected clocking position at step 830. Step 830 is followed by fixing the angle of the variable nozzle airfoil 463 and position selector at step 840.

The method of operating a gas turbine engine 100 may also include shutting down the gas turbine engine 100 prior to step 830. The method may also include loosening the locking nut 475 and removing me selector bolt 474 prior to step 830. Position selector 470 may not be free to rotate until selector bolts 474 are removed and locking nuts 475 are loosened. The method, may also include starting the gas turbine engine 100 after fixing the position selector 470 into place. Starting the gas turbine engine 100 may be preceded by tightening the locking nut 475 and by ensuring that all variable nozzle airfoils are rotated to the same angle. Ensuring that all variable nozzle airfoils are rotated to the same angle may be accomplished by the parallel or keyed first alignment edge 479 and second alignment edge 480 which may prevent variable nozzle airfoils 463 from being fixed into different angles.

It is understood that the steps disclosed herein (or parts thereof) may be performed in the order presented or out of the order presented, unless specified otherwise. For example, step 815 may be performed at any point prior to step 830. Similarly, step 825 may be performed at any point between step 810 and step 830.

The preceding detailed description is merely exemplary in nature and is not intended to limit the invention or the application and uses of the invention. The described embodiments are not limited to use in conjunction with a particular type of gas turbine engine. Hence, although the present disclosure, for convenience of explanation, depicts and describes particular turbine nozzles and associated processes, it will be appreciated that other turbine nozzles and processes in accordance with this disclosure can be implemented in various other turbine stages, configurations, and types of machines. Furthermore, there is no intention to be bound by any theory presented in the preceding background or detailed description. It is also understood that the illustrations may include exaggerated dimensions to better illustrate the referenced items shown, and are not consider limiting unless expressly stated as such.

What is claimed is:

1. A gas turbine engine variable nozzle, comprising:

an outer shroud;

an inner shroud located radially inward from the outer shroud;

a variable nozzle airfoil extending radially between the outer shroud and the inner shroud, the variable nozzle airfoil including a vane shaft extending radially outward from the variable nozzle airfoil through the outer shroud; and a position selector coupled with the variable nozzle airfoil to fixedly lock the variable nozzle airfoil into one of a plurality of preselected positions, the position selector including a plate like shape including a forward edge, an aft edge located opposite the forward edge, a first alignment edge extending between the forward edge and the aft edge, a second alignment edge located opposite the first alignment edge, wherein the first alignment edge and the second alignment edge are parallel, and a plurality of clocking positions configured for predetermined variable nozzle airfoil positions.

2. The variable nozzle of claim 1, wherein wherein the position selector is keyed to the vane shaft to prevent relative angular displacement between the position selector and the vane shaft.

3. The variable nozzle of claim 1, wherein each of the plurality of clocking positions is a through hole.

4. The variable nozzle of claim 1, wherein each of the plurality of clocking positions is a notch or a slot.

5. The variable nozzle of claim 1, wherein the position selector is configured with a dowel hole extending from a bottom of the position selector.

6. The variable nozzle of claim 5, wherein the dowel hole is a blind hole.

7. The variable nozzle of claim 1, wherein the position selector includes a selector bolt configured to be inserted into any of the plurality of clocking positions.

8. The variable nozzle of claim 1, wherein the plurality of clocking positions include a cold position, a standard position, and a hot position, wherein the cold position, standard position, and hot position are each configured for different gas turbine engine operations.

9. The variable nozzle of claim 1, wherein the vane shaft extends within the variable nozzle airfoil.

10. The variable nozzle of claim 1, wherein the vane shaft is angled between five and fifteen degrees in an axial direction with a radially outer portion of the vane shaft leaned in a forward direction.

11. A gas turbine engine including a plurality of the variable nozzles of claim 1, wherein the plurality of the variable nozzles form a variable nozzle stage.

12. A gas turbine engine variable nozzle assembly including a plurality of the variable nozzles of claim 1, wherein the variable nozzle assembly further includes:

a variable outer housing located radially outward from the plurality of variable nozzles, the variable outer housing having a plurality of holes, wherein each hole is configured to align with one of the clocking positions of the variable nozzle position selectors for a predetermined variable nozzle airfoil position;

an inter turbine duct axially preceding the variable nozzles, the inter turbine duct having
an outer wall, and
an inner wall located radially inward from the outer wall, wherein the outer wall and the inner wall are configured to diverge as the inter turbine duct extends towards the variable nozzles.

13. A gas turbine engine, comprising:
a plurality of variable nozzles, each variable nozzle having
an outer shroud;
an inner shroud located radially inward from the outer shroud;
a variable nozzle airfoil extending radially between the outer shroud and the inner shroud, the variable nozzle airfoil including a vane shaft extending radially outward from the variable nozzle airfoil through the outer shroud; and
a position selector with a plate like shape coupled with the variable nozzle airfoil to fixedly lock the variable nozzle airfoil into one of a plurality of preselected positions, the position selector including
a forward edge located axially forward,
an aft edge located axially aft,
a first alignment edge located on a side of the position selector,
a second alignment edge located on a side of the position selector opposite to the first alignment edge, wherein the first alignment edge and the second alignment edge are parallel, and
a plurality of clocking positions configured for predetermined
variable nozzle airfoil positions;
a variable outer housing located radially outward from the plurality of variable nozzles;
an inter turbine duct axially preceding the variable nozzles, the inter turbine duct having
an outer wall, and
an inner wall located radially inward from the outer wall, wherein the outer wall and the inner wall are configured to diverge as the inter turbine duct extends towards the variable nozzles.

14. The gas turbine engine of claim 13,
wherein the position selector is keyed to the vane shaft to prevent relative angular displacement between the position selector and the vane shaft.

15. The gas turbine engine of claim 13, wherein the variable outer housing includes a plurality of holes, wherein each hole is configured to align with one of the clocking positions of the variable nozzle position selectors for a predetermined variable nozzle airfoil position and the position selector includes a selector bolt configured to be inserted through any of the plurality of clocking positions and into one of the plurality of holes.

16. The gas turbine engine variable nozzle assembly of claim 15, wherein a first angle between a first clocking position and a second clocking position, and a second angle between a first hole and a second hole is different, and wherein the difference between the first angle and the second angle determines the amount of rotation of the variable nozzle airfoil when switching from a first variable nozzle airfoil position to a second variable nozzle airfoil position.

17. A gas turbine engine variable nozzle, comprising:
an outer shroud including
a first spherical surface, the first spherical surface being a radially inner surface of the outer shroud, wherein the first spherical surface is the shape of a circumferential portion of a spherical zone;
an inner shroud located radially inward from the outer shroud, the inner shroud including
a second spherical surface opposite the first spherical surface, the second spherical surface being a radially outer surface of the inner shroud, wherein the second spherical surface is the shape of a circumferential portion of a spherical zone;
a variable nozzle airfoil extending radially between the first spherical surface and the second spherical surface, the variable nozzle airfoil including
an outer edge adjacent to the first spherical surface, the outer edge having a curve which matches the contour of the first spherical surface, and
an inner edge adjacent to the second spherical surface, the inner edge having a curve which matches the contour of the second spherical surface; and
a position selector coupled with the variable nozzle airfoil to fixedly lock the variable nozzle airfoil into one of a plurality of preselected positions the position selector including a plate like shape including
a forward edge,
an aft edge located opposite the forward edge,
a first alignment edge located on a side of the position selector between the forward edge and the aft edge,
a second alignment edge located on a side of the position selector opposite the first alignment edge, wherein the first alignment edge and the second alignment edge are parallel, and
a plurality of clocking positions configured for predetermined variable nozzle airfoil positions.

18. The variable nozzle of claim 17, wherein the position selector includes a selector bolt configured to be inserted into any of the plurality of clocking positions.

19. A gas turbine engine variable nozzle assembly including a plurality of the variable nozzles of claim 17, wherein the variable nozzle assembly further includes:
a variable outer housing located radially outward from the plurality of variable nozzles, the variable outer housing having
a plurality of holes, wherein each hole is configured to align with one of the clocking positions of the variable nozzle position selectors for a predetermined variable nozzle airfoil position; and
an inter turbine duct axially preceding the variable nozzles, the inter turbine duct having
an outer wall, and
an inner wall located radially inward from the outer wall, wherein the outer wall and the inner wall are configured to diverge as the inter turbine duct extends towards the variable nozzles.

20. The gas turbine engine variable nozzle assembly of claim 19, wherein a first angle between a first clocking position and a second clocking position, and a second angle between a first hole and a second hole is different, and wherein the difference between the first angle and the second angle determines the amount of rotation of the variable nozzle airfoil when switching from a first variable nozzle airfoil position to a second variable nozzle airfoil position.

* * * * *